United States Patent [19]

Culligan

[11] 3,997,927

[45] Dec. 21, 1976

[54] SUNBATHING MAT ASSEMBLY

[76] Inventor: Robert L. Culligan, 624 Bailey Road, West Henrietta, N.Y. 14586

[22] Filed: Nov. 28, 1975

[21] Appl. No.: 636,141

[52] U.S. Cl. ..... 5/344; 4/152; 5/317 R

[51] Int. Cl.[2] ..... A47G 9/00; A47C 21/04

[58] Field of Search ..... 5/344, 370, 347, 317 R; 4/152

[56] References Cited

UNITED STATES PATENTS

| | | | |
|---|---|---|---|
| 3,466,675 | 9/1969 | Tignor | 4/160 |
| 3,653,083 | 4/1972 | Lapidus | 5/347 |
| 3,757,362 | 9/1973 | Bowlin et al. | 5/347 |
| 3,928,876 | 12/1975 | Starr | 5/347 |

*Primary Examiner*—Paul R. Gilliam
*Assistant Examiner*—Alex Grosz
*Attorney, Agent, or Firm*—Stonebraker, Shepard & Stephens

[57] ABSTRACT

A mat of soft compressible foam material is adapted to be laid on the ground on a slight slope. Running along the upper edge of the mat is a perforated conduit connected to a garden hose having a sufficient length lying in a hot sunny spot so that the water flowing slowly through the hose toward the perforated conduit becomes slightly warmed. A person lies on the mat, the weight of his body creating depressions or channels in the mat, and the water trickling from the perforated conduit at the upper edge of the mat flows down the depressions caused by the weight of the body, and cools the lower side of the body. A control valve within easy reach of the person lying on the mat determines the rate of flow of the water. Clips on the edges of the mat enable the mat to be hung vertically in a garage or other storage space when not in use.

2 Claims, 6 Drawing Figures

SUNBATHING MAT ASSEMBLY

BACKGROUND OF THE INVENTION

The invention relates to the practice of sunbathing, greatly enjoyed by many people. Many persons wish to expose large areas of their skin to the rays of the sun, in order to produce a tan or other beneficial effects, but sometimes the person becomes overheated and would like to have some cooling effect while still maintaining exposure to the sun.

Sprinkling the exposed surface of the body with water would produce a cooling effect, but is unsatisfactory and undesirable, for the reason that drops of water on the skin act as tiny lenses, concentrating the rays of the sun under each drop, so that severe burning can occur, before a person realizes that this is happening. It is therefore desirable to provide some cooling effect for the body, otherwise than by application of water to the exposed surface of the skin.

SUMMARY OF THE INVENTION

The present invention provides cooling water for the under surface of the body of a person lying in sunbathing position, without applying water to the upper surface exposed to the sun's rays, and thus not creating any water drop lenses which might cause over burning of local areas of the skin. The invention is particularly intended for home use, and comprises a soft foam mat to be laid on a slightly or gently sloping surface of a lawn or yard, in combination with a perforated conduit running along one edge of the mat (the upper edge when the mat is laid on the slope) and a garden hose having a sufficient length lying in a hot sunny location so that the water in the hose becomes slightly warmed to take the chill off, and a control valve between the discharge end of the hose and the intake end in the perforated conduit, for control of the rate of flow of water issuing from the perforations in the conduit. Because of the soft compressible nature of the foam mat, the weight of the body of a person lying on the mat will create depressed channels or valleys in the mat. The water from the perforated conduit will flow down these depressions or valleys, wetting and cooling the underside of the body of the person lying on the mat, but not undesirably chilling it because of the use of sufficient length of hose in the sunny location to take the chill off the water at the slow rate at which it flows through the hose.

DESCRIPTION OF THE PREFERRED EMBODIMENT

Figure 1:
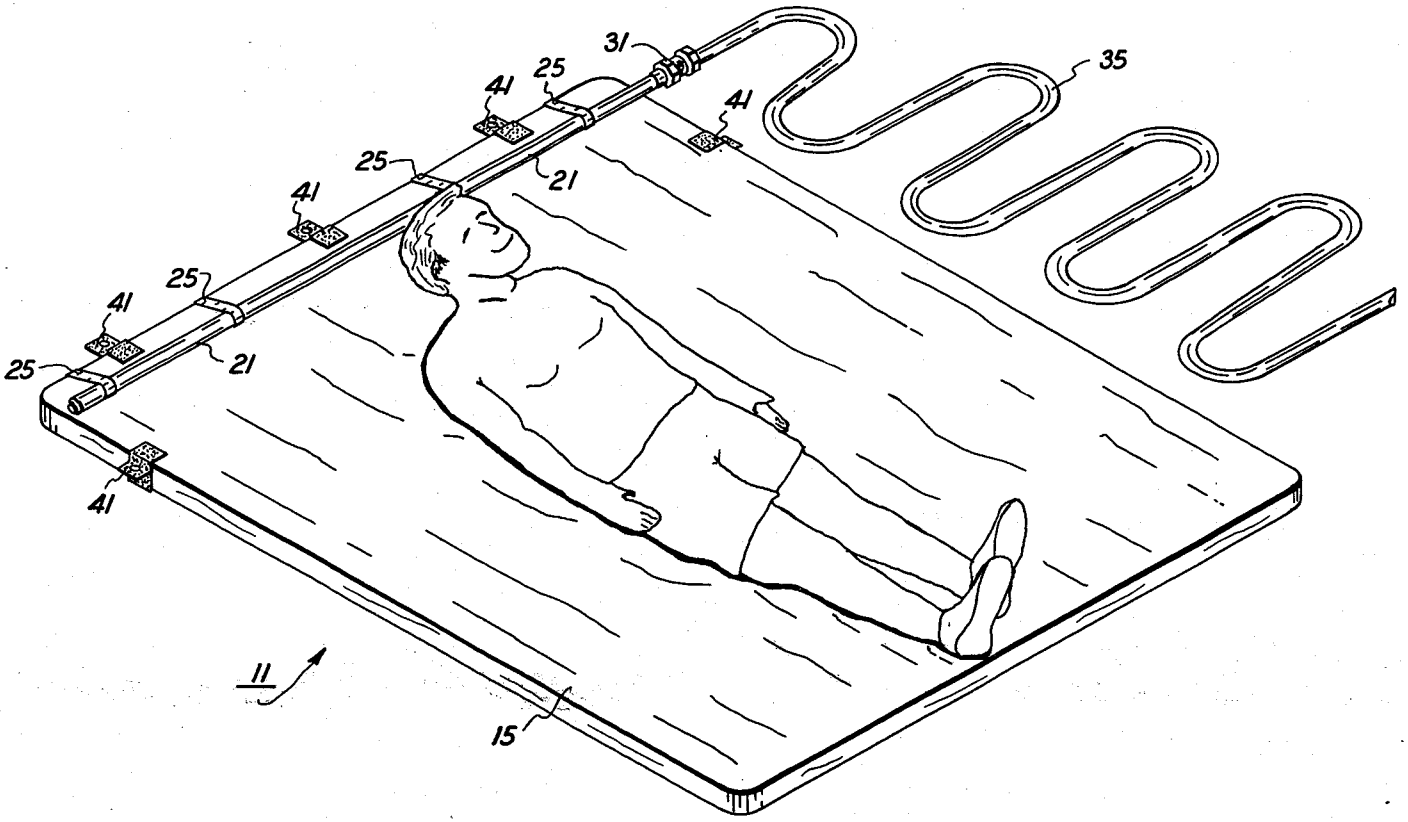
FIG. 1 is a perspective view of a sunbathing mat assembly according to a preferred embodiment of the invention, in normal position of use.

Referring now to the drawings, the preferred form of the mat is shown in general at 11. It comprises a filling 13 of soft compressible foam material of any conventional kind, contained within a waterproof covering made, for example, of conventional plastic sheeting.

Figure 6:
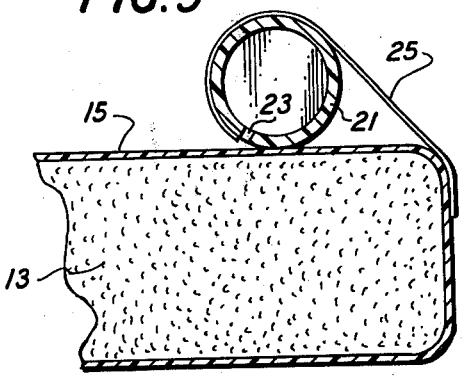
FIG. 6 is a vertical section through a fragment of the mat and the perforated conduit, taken substantially on the line 6—6 of FIG. 2.

A perforated conduit 21 runs along the top surface of the mat near one end. This is, of course, the end which would be uppermost or at the highest elevation, when the mat is laid on a slightly sloping portion of a lawn or yard. The conduit 21 may be in the form of either a metal or a plastic pipe, having a series of small holes 23 at intervals along its length, the holes being near the lower edge of the cross section of the conduit, as illustrated in FIG. 6, so that water issuing therefrom will be directed downwardly toward the top surface of the mat, rather than being projected upwardly over a person lying on the mat. The conduit is affixed to the mat in any convenient way, such as by the fastening members 25 spaced at intervals along the adjacent edge of the mat. These fastening members may be temporary adhesive tapes, or more permanent strong flexible adhesive tapes with high strength permanent adhesive, or metal clips, or of any other suitable form.

Figure 2:
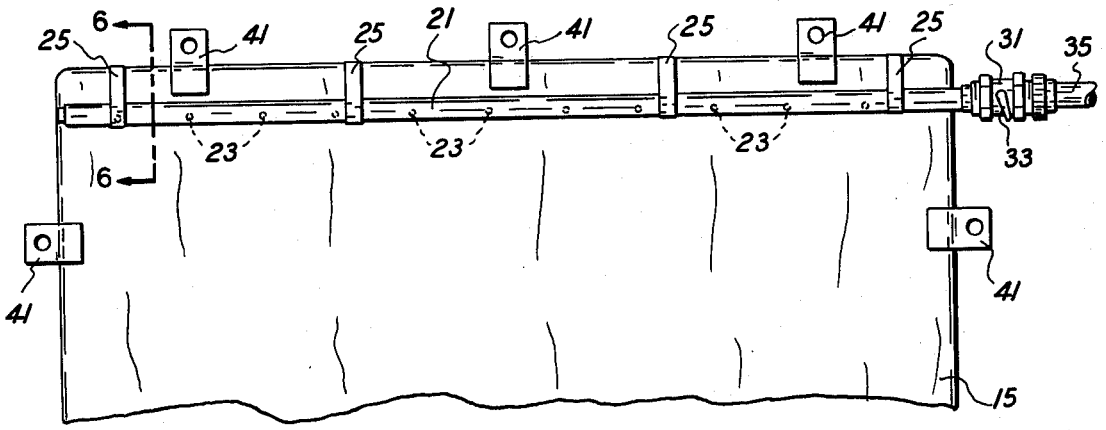
FIG. 2 is a fragmentary plan view of a portion of the mat which is at the top when the mat is laid on a slope.
Figure 3:
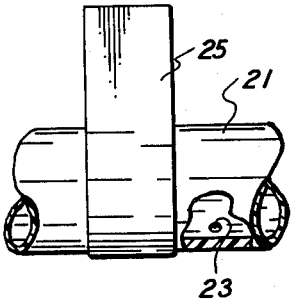
FIG. 3 is a fragmentary enlarged view of a portion of the perforated conduit.
Figure 4:
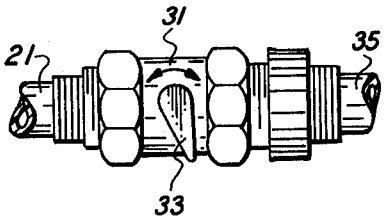
FIG. 4 is a view illustrating the connection between the hose in the perforated conduit, and the control valve located at this point.
Figure 5:
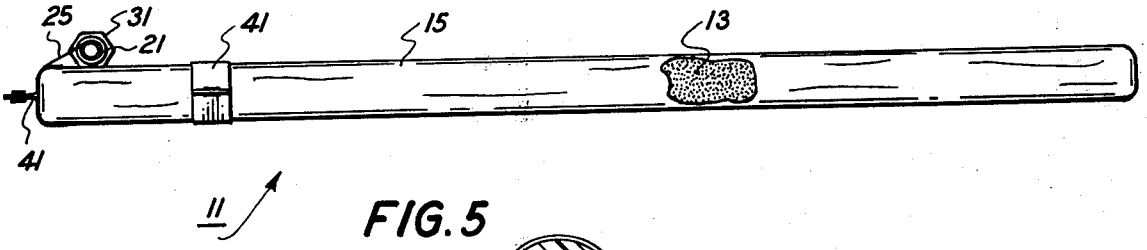
FIG. 5 is an edge view of the mat, with the outer covering broken away at one point.

One end of the conduit 21 is plugged or closed, such as the left end when viewed as in FIG. 2. The other end of the conduit has any suitable water tight connection, such as a threaded connection, with a conventional water flow control valve 31 having a manually operable handle 33. At the opposite end of this control valve 31 is another water tight connection, such as a threaded connection, with a water supply hose 35, preferably an ordinary garden hose of the kind customarily used in households. The opposite end of the hose is, of course, connected to a conventional water supply faucet, such as the outdoor cold water faucet customarily found at most homes.

Preferably the hose 35 is a relatively thin walled hose, rather than a thick walled hose, and preferably also it is of a dark color, such as black or dark green, since a dark color will better absorb the heat rays from the sun, while a lighter color tends to reflect the rays rather than abosrb them. It is well known that water issuing from a cold water faucet, at least after it has run for any length of time, is ordinarily quite chilly, and would be uncomfortably cold in contact with the body of a sunbather. The hose 35 should be of sufficient length (preferably at least 50 feet) so that, when laid in a sunny location on the lawn or yard, it constitutes heating means for slightly heating the water as it flows, at a relatively slow rate, from the supply faucet to the perforated conduit 21. The water is not heated to any great degree, but is heated sufficiently to take the chill off the water, so that it is not unpleasantly cold as it trickles out of the perforations in the conduit 21 and flows slowly down the valleys or depressions formed in the top surface of the mat by the weight of the person lying on it.

In FIG. 1, the hose 35 is illustrated as being laid in a sinuous path or pattern, beside the mat. This is merely for illustrative purposes. Of course the shape in which the hose is laid does not affect the heating efficiency. The important thing is to have a sufficient length of the hose, whether straight or curved, lying in a location where it is fully exposed to the hot rays of the sun. A fifty foot length of hose will usually be sufficient if the sun is reasonably hot and the tap water supply to the hose is not unduly cold. If the person using this invention likes to feel the water a little warmer, a one hundred foot length of hose may be used.

The size of the may may be varied as desired. Ordinarily a mat about seven feet long and five feet wide will conveniently accommodate two persons lying side by side, but of course the mat can be made narrower if intended for only a single person, or wider if more space is desired.

Hangers are preferably provided along one or more edges of the mat, to serve when hanging the mat in a vertical storage positon in the householder's garage or other storage space, and also to serve as handles or gripping members for easy handling and transportation of the mat. Such hangers are shown at 41, and may be in the form of sheet metal members fastened to the edges of the mat and having projecting flanges with apertures which may be impaled on a hook or nail for hanging purposes. Alternatively, these members 41 may be of strong flexible material, such as fabric or plastic strips.

The thickness of the mat is preferably from one and a half inches to three inches, the foam material being sufficiently thick and sufficiently flexible and compressible so that the weight of the person's body will form water-directing depressed channels in the upper surface of the mat.

Although the mat is preferably placed on a slight slope, it may be used also on a level surface such as the flat deck or pavement surrounding a swimming pool, or on a perfectly level lawn. The water would not run off in quite the same way as on a sloping surface, but nevertheless there would be the same beneficial effect of keeping the lower side of a person's body wet with pleasant cool water, while the upper side is exposed to the sun.

Alternatively, the mat may be wedge shaped in thickness, thicker at one end than at the other, so the water would run down the channels even when the mat is laid on a level surface. For example, it may be 2 inches thick at one end, increasing gradually to 6 inches at the other.

Most people will prefer not to have the water sprayed onto the top surface of their bodies, for the reasons already explained above. It is within the scope of the invention, however, to adjust the position of the perforated conduit so that water will be sprayed on top of the person on the mat, if desired, or will be delivered in any desired direction or location. To this end, although the conduit may be fastened to the mat by permanent adhesive tapes or other permanent means, it may be more convenient to use a more temporary kind of tape, easily peelable off the mat or the conduit to enable quick changing of the location or orientation of the conduit relative to the mat. The tape, when peeled off, may be reusable, or may be used only once and replaced from a fresh supply roll. A convenient tape to use is "Scotch" brand plastic adhesive tape of the waterproof and stretchy variety, available on the market from 3M Company of St. Paul, Minn.

When using such fastening tape, or any equivalent easily peelable tape, it is an easy matter, at the conclusion of the sun bathing interval, to remove the conduit from the mat and move the conduit over the area of the mat, to wash the entire surface of the mat. Also the conduit, while thus detached from the mat, may be used to wash or rinse off the body of the person who has completed the desired sun bathing.

The invention is not limited to any specific materials. Merely as typical examples of satisfactory materials, the foam of the mat may be what is known as urethane med foam, the water resistant cover may be copolymer plastic supplied by Thermwell Products Co., Inc., of Paterson, N. J., the conduit may be of Genova CPVC plastic water pipe, and the control valve may be a "Nelson" shut-off coupling available from L. R. Nelson Corp. of Peoria, Ill. A satisfactory kind of tape has been separately mentioned above.

What is claimed is:

1. A sunbathing mat assembly comprising a compressible mat sufficiently flexible so that the weight of the body of a person lying on the mat will form depressed channels in the upper surface of the mat, a water conduit adjacent said upper surface of a portion of said mat, said conduit having a row of perforations spaced longitudinally along said conduit, means for securing said conduit to said mat approximately along an edge thereof to direct said perforations toward said upper surface of said mat, and means for coupling said conduit to a water supply for supplying water to said conduit to flow into the conduit and out through the perforations thereof and directly downward onto the upper surface of the mat and along some of said depressed channels to cool a lower portion of said body without wetting an upper portion of said body exposed to the sun's rays.

2. The invention defined in claim 1, further comprising peelable adhesive tape detachably fastening said conduit to said mat.

* * * * *